US007178197B2

(12) United States Patent
Verheye, Sr.

(10) Patent No.: US 7,178,197 B2
(45) Date of Patent: Feb. 20, 2007

(54) GUARD ASSEMBLY FOR A SECTIONAL GARAGE DOOR

(75) Inventor: Joseph Verheye, Sr., Shelby Township, MI (US)

(73) Assignee: Quest Technical Design, LLC, Shelby Township, MI (US)

( * ) Notice: Subject to any disclaimer, the term of this patent is extended or adjusted under 35 U.S.C. 154(b) by 324 days.

(21) Appl. No.: 10/707,887

(22) Filed: Jan. 21, 2004

(65) Prior Publication Data

US 2005/0155725 A1 Jul. 21, 2005

(51) Int. Cl.
*E05D 11/00* (2006.01)

(52) U.S. Cl. ..... 16/250; 16/251; 160/229.1

(58) Field of Classification Search ..... 16/250, 16/251, 372, 225; 160/229.1, 201; 49/460, 49/383

See application file for complete search history.

(56) References Cited

U.S. PATENT DOCUMENTS

| | | | | |
|---|---|---|---|---|
| 1,268,104 | A * | 6/1918 | Flick et al. | 16/366 |
| 3,319,697 | A * | 5/1967 | Krohn | 160/229.1 |
| 3,376,913 | A * | 4/1968 | Clapsaddle | 160/201 |
| 3,846,868 | A * | 11/1974 | Brydolf | 16/255 |
| 5,002,114 | A * | 3/1991 | Hormann | 160/229.1 |
| 5,056,191 | A * | 10/1991 | Love | 16/251 |
| 5,490,306 | A * | 2/1996 | Floyd et al. | 16/250 |
| 6,527,036 | B1 * | 3/2003 | Welsh | 160/201 |
| 6,698,492 | B2 * | 3/2004 | Lewis, Jr. | 160/201 |

FOREIGN PATENT DOCUMENTS

GB 2082671 A * 3/1982

* cited by examiner

*Primary Examiner*—Chuck Y. Mah
*Assistant Examiner*—Michael J. Kyle
(74) *Attorney, Agent, or Firm*—Thomas E. Donohue, Esq.; Artz & Artz, P.C.

(57) ABSTRACT

A guard assembly is provided for use with a sectional garage door. The sectional garage door includes a plurality of sectional panels connected by garage door hinges. Each hinge is comprised of a first hinge plate attached to one of the sectional panels with a first attachment, a second hinge plate attached to an adjoining sectional panel with a second attachment, a hinge knuckle extending upwards from the first hinge plate and the second hinge plate, and a hinge shaft mounted within the hinge knuckle. The hinge shaft rotatably joins the first hinge plate to the second hinge plate. The guard assembly comprises a first guard element comprising a first shaft engagement end configured to rotatably engage the hinge shaft, the first shaft engagement end having a first shaft engagement upper surface configured to protrude beyond the hinge knuckle when the first guard element is attached to the hinge shaft. A first plate engagement end is adapted to engage the first hinge plate. A first transition body portion is positioned between the first shaft engagement end and the first plate engagement end. A second guard element is included comprising a second shaft engagement end configured to rotatably engage the hinge shaft. The second shaft engagement end has a second shaft engagement upper surface configured to protrude beyond the hinge knuckle when the second guard element is attached to the hinge shaft. A second plate engagement end is adapted to engage the second hinge plate. A second transition body portion is positioned between the second shaft engagement end and the second plate engagement end. The second guard element rotates independently from the first guard element.

20 Claims, 3 Drawing Sheets

GUARD ASSEMBLY FOR A SECTIONAL GARAGE DOOR

BACKGROUND OF INVENTION

The present invention relates generally to a guard assembly and more particularly to a guard assembly for use on a sectional garage door to prevent damage to improperly parked vehicles within the garage.

Modern automotive vehicles represent a considerable investment for the average consumer. Vehicles can represent a combination of utility and luxury. It is this combination of investment and utility that instills a sense of pride in vehicle ownership. Owners, therefore, support a plurality of industries designed to maintain and restore vehicle appearance. Between car washes, detailing, and after-market products, vehicle owners invest considerable time and money into maintaining a vehicle's original luster.

A vehicle's appearance faces a variety of hazards in every day usage. Although such hazards are commonly associated with accidents or environmental damage, a lesser known source of hazard exists within the very garage associated with protecting the vehicle. This source of hazard is the garage door generally and more specifically the garage door hinges connecting individual sections of a sectional garage door. As vehicle size has increased and garage storage usage has increased, the available space within the garage dedicated to positioning the vehicle has decreased. This places an often unreasonable burden on drivers to successfully position the vehicle within the garage such that the rear of the vehicle is clear of the lowering garage door components.

Failure to properly position the vehicle in the garage can result in contact between the garage door hinges and the vehicle rear or front bumper. The sharp edges of the metal hinges can impart visible scarring onto the vehicle bumper. Modern painted and molded bumpers can further exacerbate this problem by being highly susceptible to visible scratches. Even traditional steel bumpers may be visibly marred through contact with the garage door hinge. Damage to the bumpers can not only diminish the vehicle's appearance but can represent costly lease return charges. High tech sensor used in combination with automated garage doors are commonly positioned in locations to detect small children or animals and are often not in a position to detect the vehicle bumper. In addition, high tech sensors generate installation costs and reliability issues.

Therefore, an inexpensive and low-tech methodology for protecting a vehicle's bumper from the garage door hinges would provide a considerable benefit to consumers.

SUMMARY OF INVENTION

It is therefore an object of the present invention to provide a guard assembly for preventing damaging contact between an automobile and a garage door hinge. It is a further object of the present invention to provide a guard assembly with improved installation characteristics.

In accordance with the objects of the present invention a guard assembly is provided. The guard assembly is provided for use with a sectional garage door. The sectional garage door includes a plurality of sectional panels connected by garage door hinges. Each hinge is comprised of a first hinge plate attached to one of the sectional panels with a first attachment, a second hinge plate attached to an adjoining sectional panel with a second attachment, a hinge knuckle extending upwards from the first hinge plate and the second hinge plate, and a hinge shaft mounted within the hinge knuckle. The hinge shaft rotatably joins the first hinge plate to the second hinge plate. The guard assembly comprises a first guard element comprising a first shaft engagement end configured to rotatably engage the hinge shaft, the first shaft engagement end having a first shaft engagement upper surface configured to protrude beyond the hinge knuckle when the first guard element is attached to the hinge shaft. A first plate engagement end is adapted to engage the first hinge plate. A first transition body portion is positioned between the first shaft engagement end and the first plate engagement end. A second guard element is included comprising a second shaft engagement end configured to rotatably engage the hinge shaft. The second shaft engagement end has a second shaft engagement upper surface configured to protrude beyond the hinge knuckle when the second guard element is attached to the hinge shaft. A second plate engagement end is adapted to engage the second hinge plate. A second transition body portion is positioned between the second shaft engagement end and the second plate engagement end. The second guard element rotates independently from the first guard element.

Other objects and features of the present invention will become apparent when viewed in light of the detailed description and preferred embodiment when taken in conjunction with the attached drawings and claims.

DETAILED DESCRIPTION

Figure 1:
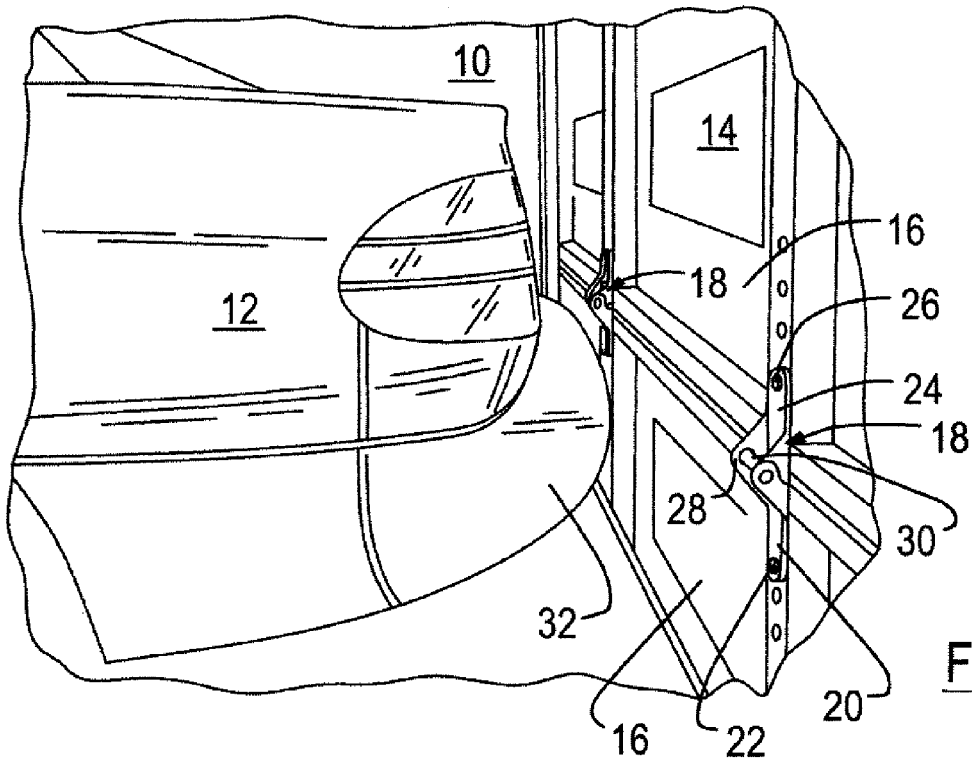
FIG. 1 is an illustration of a guard assembly illustrated mounted within a garage in accordance with the present invention, a guard assembly was left off one of the garage door hinges such that the garage door hinge could be properly viewed.

Referring now to FIG. 1, which is an illustration of a garage 10 housing an automobile 12. The garage 10 includes a sectional garage door 14 containing a plurality of adjoining sectional panels 16 connected together by a plurality of garage door hinges 18. Each hinge 18 is comprised of a first hinge plate 20 attached to one of the sectional panels 16 through the use of a first attachment 22 (such as a bolt or rivet). A second hinge plate 24 is attached to an adjoining sectional panel 16 through the use of a second attachment 26. A hinge knuckle 28 extends upwards from the first hinge plate 20 and second hinge plate 24. A hinge shaft 30 is mounted within the hinge knuckle 28 and rotatably joins the first hinge plate 20 to the second hinge plate 24. This allows the sectional panels 16 to pivot relative to one another as they are moved between their respective horizontal open positions and vertical closed positions as the garage door 14 is opened and closed.

Figure 2:
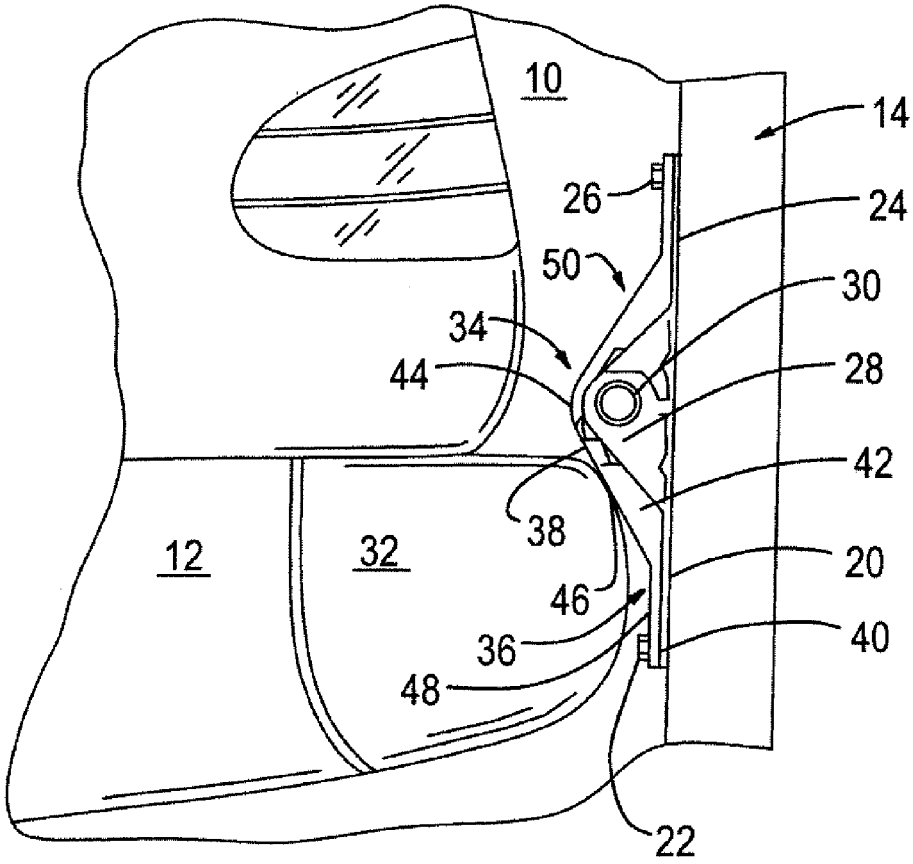
FIG. 2 is an illustration the guard assembly illustrated in FIG. 1, the guard assembly illustrated in contact with a vehicle bumper.
Figure 6:
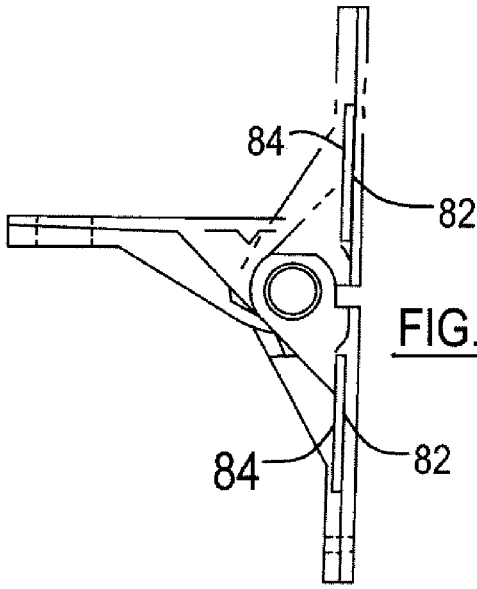
FIG. 6 is a side-view illustration of the guard assembly illustrated in FIG. 5.
Figure 7:
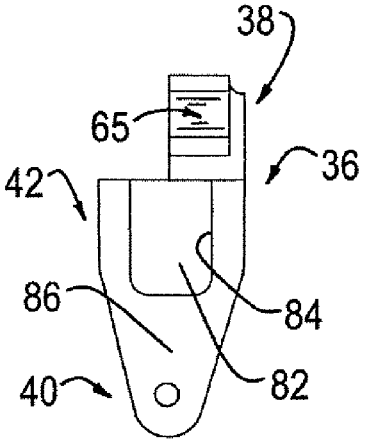
FIG. 7 is a bottom-view detail illustration of a guard element for use in the guard assembly illustrated in FIG. 2.

It is possible, in existing garage door designs, for the hinge knuckle 28 to contact the bumper 32 of a vehicle 12 parked within the garage 10 as the garage door 14 is lowered. This can cause potential damage or visible scarring to the bumper 32. The present invention addresses this concern by providing a guard assembly 34 (see FIG. 2) that is mountable to the garage door hinges 18 to prevent contact between the bumper 32 and the hinge knuckle 28 of the garage door hinges 18. The guard assembly 34 is comprised of a first guard element 36 having a first shaft engagement end 38, a first plate engagement end 40, and a first transition body portion 42. The first shaft engagement end 38 defines a first shaft engagement upper surface 44 that protrudes beyond the hinge knuckle 28 such that the first shaft engagement upper surface 44 interferes with contact between the bumper 32 and the hinge knuckle 28. The first transition body portion 42 preferably defines a first transition body upper surface 46 that also protrudes beyond the hinge knuckle 28. Although the first transition body portion 42 can be formed in a variety of fashions, one embodiment contemplates the use of a flat surface angled (a ramp) between the first shaft engagement end 38 and the first plate engagement end 40 to provide a gradual increase in pressure on the bumper 32 (see FIG. 6). In at least one embodiment, the first plate engagement end 40 can define a first plate engagement upper surface 48 that protrudes above the first hinge plate 20 to further reduce incidents of contact between hinge 18 and bumper 32. In this fashion, the entire contact area of the hinge 18 is guarded. The first guard element 36, or entire guard assembly 34, is preferably manufactured from a non-abrasive material such as a non-abrasive polymer to prevent marring of the bumper 32 finish from contact with the guard assembly 34. In addition, the guard assembly 34 protects the hinge 18 from contact with automotive features such as trailer hook assemblies that may damage or tear off the hinge 18 if not guided over.

The guard assembly 34 can further include a second guard element 50 mounted opposing the first guard element 36. The second guard element 50 includes a second shaft engagement end 52, a second plate engagement end 54, and a second transition body portion 56. The second shaft engagement end 52 defines a second shaft engagement upper surface 58 that protrudes beyond the hinge knuckle 28 such that the second shaft engagement upper surface 58 interferes with contact between the bumper 32 and the hinge knuckle 28. The second transition body portion 56 preferably defines a second transition body upper surface 60 that also protrudes beyond the hinge knuckle 28. In at least one embodiment, the second plate engagement end 54 can define a second plate engagement upper surface 62 that protrudes above the second hinge plate 24 to further reduce incidents of contact between hinge 18 and bumper 32. It is contemplated that the first guard element 36 and second guard element 50 are mounted independently from one another to the hinge 18 and rotate independently from one another. The use of both the first guard element 36 and the second guard element 50 protects during movement of the garage door 14 both as it is raised and as it is lowered and thus providing dual direction protection.

Figure 3:
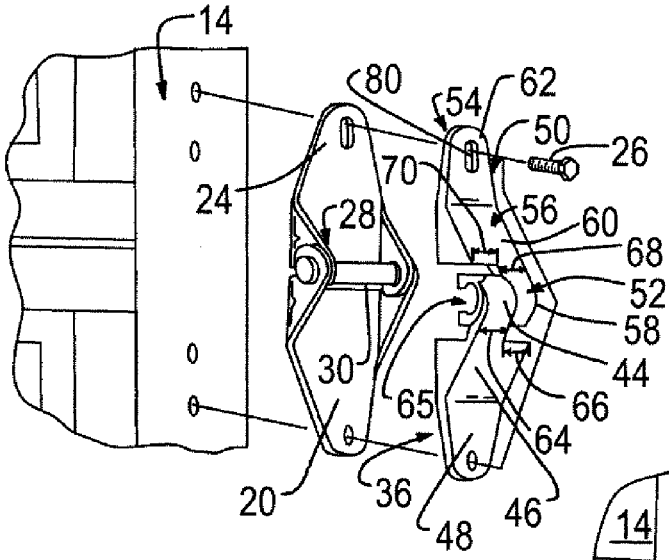
FIG. 3 is an illustration of the guard assembly illustrated in FIG. 2, the guard assembly showing one mounting embodiment.
Figure 5:
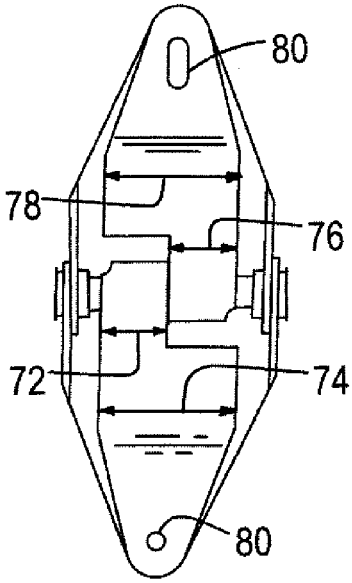
FIG. 5 is a detail top-view illustration of the guard assembly illustrated in FIG. 2.
Figure 8:
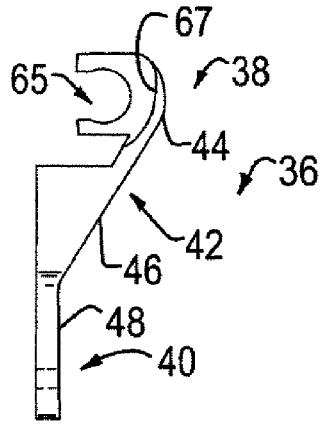
FIG. 8 is a side-view detail illustration of the guard assembly illustrated in FIG. 7.

It is contemplated that the first guard element 36 and second guard element 50 can be manufactured with a variety of mounting characteristics that facilitate their sale and use as aftermarket products for existing garage doors. In one embodiment (see FIG. 3) the first shaft engagement end 38 comprises at least one first shaft engagement finger 64 defining a c-clamp engagement feature 65 such that the first shaft engagement end 38 can be press-fit into rotatable communication with the hinge shaft 30. A first knuckle groove 67 can be formed in the first shaft engagement end 38 such that the first shaft engagement upper surface 44 can protrude horizontally over the hinge knuckle 28 (see FIG. 8). The first shaft engagement finger 64 is preferably paired with and positioned next to at least one first finger gap 66. This allows a second shaft engagement finger 68 to be positioned and rotated within the first finger gap 66. The second shaft engagement finger 68 is preferably paired with and positioned next to at least one second finger gap 70 such that the first shaft engagement finger 64 can be positioned and rotated within the second finger gap 70. The first guard element 36 preferably is comprised of a first shaft engagement end width 72 (see FIG. 5) and a first transition body width 74. Similarly, the second guard element 50 is preferably comprised of a second shaft engagement end width 76 and a second transition body width 78. In at least one embodiment, it is contemplated that the first shaft engagement end width 72 added to the second shaft engagement end width 76 is less than or equal to the first transition body width 74. This provides an approximately constant width protective surface over which the bumper 32 can travel.

Figure 4:
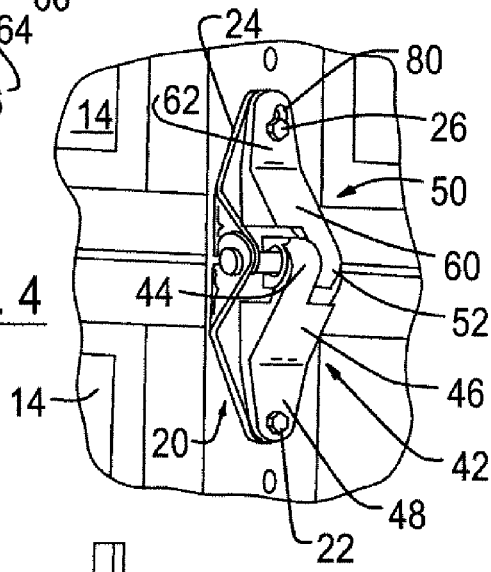
FIG. 4 is an illustration of the guard assembly illustrated in FIG. 3, the guard assembly illustrated in final installed form.
Figure 9:
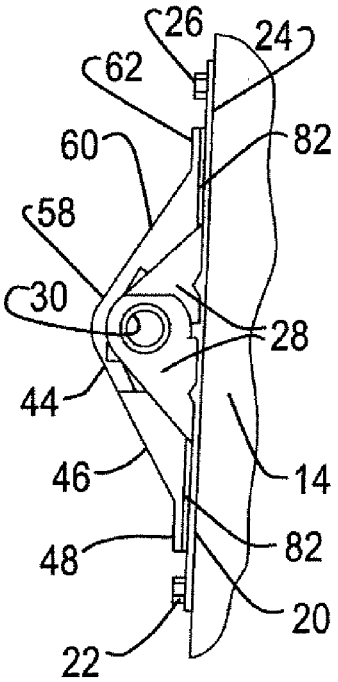
FIG. 9 is a side-view detail illustration of the guard assembly illustrated in FIG. 2, the illustration indicating an alternate mounting embodiment.

The first plate engagement end 40 and second plate engagement end 54 are adapted to mount to the first hinge plate 20 and second hinge plate 24 respectively. It is contemplated that this may be accomplished in a variety of fashions. In the embodiments illustrated in FIGS. 3 and 4, the first attachment 22 and second attachment 26 are utilized to secure the guard assembly 34 through the use of engagement slots 80 formed in the first plate engagement end 40 and second plate engagement end 54. It is contemplated, however, that attachment methodologies that do not require removal of the attachments 22,26 may be desirable. In these scenarios, the present invention contemplates embodiments such as the use of adhesive elements 82 positioned between the first plate engagement end 40 and the first hinge plate 20 and the second plate engagement end 54 and second hinge plate 24 respectively. This allows a simple press-fit engagement between the plate engagement ends 40,54 and the hinge plates 20,24 (see FIGS. 6 and 9). An edifice 84 may be formed in the bottom surface 86 of the first plate engagement end 40 wherein the adhesive element 82 may be positioned. This allows for an improved flat engagement. An additional advantage of the use of adhesive elements 82 is they allow for simple removal of the guard assembly 34.

Figure 11:
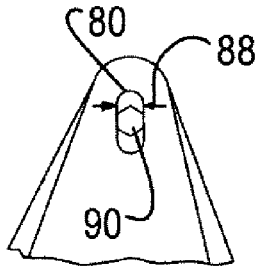
FIG. 11 is a detailed view of the alternate mounting embodiment illustrated in FIG. 10.
Figure 10:
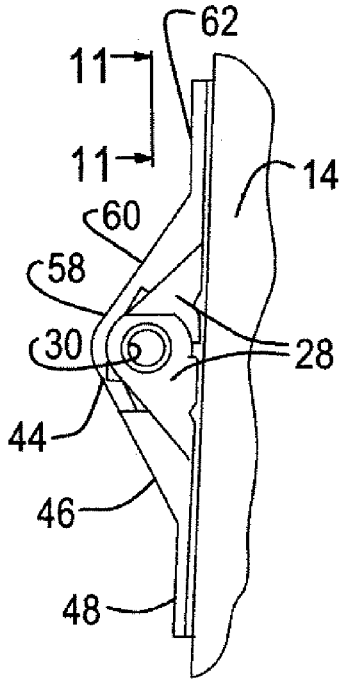
FIG. 10 is a side-view detail illustration of the guard assembly illustrated in FIG. 2, the illustration indicating an alternate mounting embodiment.

In still another embodiment, it is contemplated that engagement slots 80 may be formed to press-fit engage the attachments 22,26 such that the attachments 22,26 need not be removed to install the guard assembly 34. In one such embodiment, illustrated in FIGS. 10 and 11, the engagement slot 80 comprises an engagement slot width 88 slightly less than the attachment width 90. In this fashion, the engagement slot 80 can be press-fit into secure communication with the attachment 22,26 to secure the plate engagement ends 40,54 to the hinge plates 20,24. It should be understood, that although a number of methods of securing the plate engagement ends 40,54 to the hinge plates 20,24 have been described, they are illustrative of a wide variety of methodologies contemplated by the present invention.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

The invention claimed is:

1. A guard assembly for use with a sectional garage door, the sectional garage door includes a plurality of sectional panels connected by garage door hinges, each hinge is comprised of a first hinge plate attached to one of the sectional panels with a first attachment, a second hinge plate attached to an adjoining sectional panel with a second attachment, a hinge knuckle extending upwards from the first hinge plate and the second hinge plate, and a hinge shaft mounted within the hinge knuckle, the hinge shaft rotatably joining the first hinge plate to the second hinge plate, the guard assembly comprising:

a first guard element comprising:

a first shaft engagement end configured to rotatably engage the hinge shaft, said first shaft engagement end having a first shaft engagement upper surface configured to protrude beyond the hinge knuckle when said first guard element is attached to the hinge shaft, said first shaft engagement end positioned entirely between the hinge knuckle;

a first plate engagement end adapted to engage the first hinge plate; and a first transition body portion positioned between said first shaft engagement end and said first plate engagement end; and a second guard element comprising:

a second shaft engagement end configured to rotatably engage the hinge shaft, said second shaft engagement end having a second shaft engagement upper surface configured to protrude beyond the hinge knuckle when said second guard element is attached to the hinge shaft;

a second plate engagement end adapted to engage the second hinge plate; and a second transition body portion positioned between said second shaft engagement end and said second plate engagement end;

wherein said second guard element rotates independently from said first guard element.

2. A guard assembly as described in claim 1, wherein:

said first shaft engagement end comprising a first engagement end width;

said first transition body portion comprising a first transition body width;

said second shaft engagement end comprises a second engagement end width; and wherein said first engagement end width combined with said second engagement end width is equal to or less than said first transition body width.

3. A guard assembly as described in claim 1, wherein:

said first transition body portion comprises a first transition body upper surface, said first transition body upper surface protruding beyond the hinge knuckle when said first guard element is attached to the hinge shaft.

4. A guard assembly as described in claim 1, wherein:

said first plate engagement end comprises a first plate engagement end upper surface; and said first plate engagement end upper surface protruding beyond the first hinge plate.

5. A guard assembly as described in claim 1, wherein said first transition body portion comprises a flat surface angled between said first shaft engagement upper surface and a first engagement plate upper surface.

6. A guard assembly as described in claim 1, wherein said first guard element comprises a non-abrasive material.

7. A guard assembly as described in claim 1, wherein said first guard element comprises a non-abrasive polymer.

8. A guard assembly for use with a sectional garage door, the sectional garage door includes a plurality of sectional panels connected by garage door hinges, each hinge is comprised of a first hinge plate attached to one of the sectional panels with a first attachment, a second hinge plate attached to an adjoining sectional panel with a second attachment, a hinge knuckle extending upwards from the first hinge plate and the second hinge plate, and a hinge shaft mounted within the hinge knuckle, the hinge shaft rotatably joining the first hinge plate to the second hinge plate, the guard assembly comprising:

a first guard element comprising:

a first shaft engagement end configured to rotatably engage the hinge shaft, said first shaft engagement end having a first shaft engagement upper surface configured to protrude beyond the hinge knuckle when said first guard element is attached to the hinge shaft;

a first plate engagement end adapted to engage the first hinge plate; and a first transition body portion positioned between said first shaft engagement end and said first plate engagement end; and a second guard element comprising:

a second shaft engagement end configured to rotatably engage the hinge shaft, said second shaft engagement end having a second shaft engagement upper surface configured to protrude beyond the hinge knuckle when said second guard element is attached to the hinge shaft;

a second plate engagement end adapted to engage the second hinge plate; and a second transition body portion positioned between said second shaft engagement end and said second plate engagement end;

wherein said second guard element rotates independently from said first guard element;

wherein said first shaft engagement end comprises a c-clamp engagement feature configured to removably engage the hinge shaft.

9. A guard assembly for use with a sectional garage door, the sectional garage door includes a plurality of sectional panels connected by garage door hinges, each hinge is comprised of a first hinge plate attached to one of the sectional panels with a first attachment, a second hinge plate attached to an adjoining sectional panel with a second attachment, a hinge knuckle extending upwards from the first hinge plate and the second hinge plate, and a hinge shaft mounted within the hinge knuckle, the hinge shaft rotatably joining the first hinge plate to the second hinge plate, the guard assembly comprising:

a first guard element comprising:

a first shaft engagement end configured to rotatably engage the hinge shaft, said first shaft engagement end having a first shaft engagement upper surface configured to protrude beyond the hinge knuckle when said first guard element is attached to the hinge shaft;

a first plate engagement end adapted to engage the first hinge plate; and a first transition body portion positioned between said first shaft engagement end and said first plate engagement end;

an engagement slot formed in said first plate engagement end adapted to provide a means for the first attachment to secure the first plate engagement end to the first hinge plate; and a second guard element comprising:

a second shaft engagement end configured to rotatably engage the hinge shaft, said second shaft engagement end having a second shaft engagement upper surface configured to protrude beyond the hinge knuckle when said second guard element is attached to the hinge shaft;

a second plate engagement end adapted to engage the second hinge plate; and a second transition body portion positioned between said second shaft engagement end and said second plate engagement end;

wherein said second guard element rotates independently from said first guard element.

10. A guard assembly for use with a sectional garage door, the sectional garage door includes a plurality of sectional panels connected by garage door hinges, each hinge is comprised of a first hinge plate attached to one of the sectional panels with a first attachment, a second hinge plate attached to an adjoining sectional panel with a second attachment, a hinge knuckle extending upwards from the first hinge plate and the second hinge plate, and a hinge shaft mounted within the hinge knuckle, the hinge shaft rotatably joining the first hinge plate to the second hinge plate, the guard assembly comprising:

a first guard element comprising:

a first shaft engagement end configured to rotatably engage the hinge shaft, said first shaft engagement end having a first shaft engagement upper surface configured to protrude beyond the hinge knuckle when said first guard element is attached to the hinge shaft;

a first plate engagement end adapted to engage the first hinge plate; and a first transition body portion positioned between said first shaft engagement end and said first plate engagement end;

an engagement element formed in said first plate engagement end, said engagement element configured to frictionally engage the first attachment; and a second guard element comprising:

a second shaft engagement end configured to rotatably engage the hinge shaft, said second shaft engagement end having a second shaft engagement upper surface configured to protrude beyond the hinge knuckle when said second guard element is attached to the hinge shaft;

a second plate engagement end adapted to engage the second hinge plate; and a second transition body portion positioned between said second shaft engagement end and said second plate engagement end;

wherein said second guard element rotates independently from said first guard element.

11. A guard assembly as described in claim 1, further comprising:

an adhesive element mounted to a first plate engagement end lower surface, said adhesive element providing a means for securing said first plate engagement end to the first hinge plate.

12. A guard assembly as described in claim 11, further comprising:

a edifice formed on said first plate engagement end lower surface, said adhesive element positioned within said edifice.

13. A guard assembly for use with a garage door, the garage door includes a plurality of panels connected by garage door hinges, each hinge is comprised of a first hinge plate attached to one of the panels with a first attachment, a second hinge plate attached to an adjoining panel with a second attachment, a hinge knuckle extending upwards from the first hinge plate and the second hinge plate, and a hinge shaft mounted within the hinge knuckle, the hinge shaft rotatably joining the first hinge plate to the second hinge plate, the guard assembly comprising:

a first guard element comprising:

at least one first shaft engagement finger configured to rotatably engage the hinge shaft, said first shaft engagement finger having a first shaft engagement upper surface configured to protrude beyond the hinge knuckle when said first guard element is attached to the hinge shaft;

at least one first finger gap paired to and positioned adjacent said at least one first shaft engagement finger;

a first plate engagement end adapted to engage the first hinge plate; and a first transition body portion positioned between said first shaft engagement finger and said first plate engagement end; and a second guard element comprising:

at least one second shaft engagement finger configured to rotatably engage the hinge shaft, said second shaft engagement finger having a second shaft engagement upper surface configured to protrude beyond the hinge knuckle when said second guard element is attached to the hinge shaft, said second shaft engagement finger configured to rotate within said at least one first finger gap;

at least one second finger gap paired to and positioned adjacent said at least one second shaft engagement finger, said at least one first shaft engagement finger configured to rotate within said at least one second finger gap;

a second plate engagement end adapted to engage the second hinge plate; and a second transition body portion positioned between said second shaft engagement finger and said second plate engagement end;

wherein said second guard element rotates independently from said first guard element.

14. A guard assembly as described in claim 13, further comprising:

a first knuckle groove formed on said at least one first shaft engagement finger in a position below said first shaft engagement upper surface, said first knuckle groove configured to house the hinge knuckle.

15. A guard assembly as described in claim 13, wherein:

said first shaft engagement finger comprising a first engagement end width;

said first transition body portion comprising a first transition body width;

said second shaft engagement finger comprises a second engagement end width; and wherein said first engagement end width combined with said second engagement end width is equal to or less than said first transition body width.

16. A guard assembly as described in claim 13, wherein:

said first transition body portion comprises a first transition body upper surface, said first transition body upper surface protruding beyond the hinge knuckle when said first guard element is attached to the hinge shaft.

17. A guard assembly for use with a sectional garage door, the sectional garage door includes a plurality of sectional panels connected by garage door hinges, each hinge is comprised of a first hinge plate attached to one of the sectional panels with a first attachment, a second hinge plate attached to an adjoining sectional panel with a second attachment, a hinge knuckle extending upwards from the first hinge plate and the second hinge plate, and a hinge shaft mounted within the hinge knuckle, the hinge shaft rotatably joining the first hinge plate to the second hinge plate, the guard assembly comprising:

a first guard element comprising:

a first shaft engagement end rotatably engage the hinge shaft, said first shaft engagement end having a first shaft engagement upper surface protruding beyond the hinge knuckle when said first guard element is attached to the hinge shaft, said first shaft engagement end positioned entirely between the hinge knuckle;

a first plate engagement end adapted to engage the first hinge plate; and a first transition body portion positioned between said first shaft engagement end and said first plate engagement end.

18. A method of protecting an automobile from damage from a garage door hinge, the hinge comprised of a first hinge plate, a second hinge plate, a hinge knuckle extending upwards from the first hinge plate and the second hinge plate, and a hinge shaft mounted within the hinge knuckle, the hinge shaft rotatably joining the first hinge plate to the second hinge plate, comprising:

attaching a first guard element to the hinge by:

press-fitting a first shaft engagement finger into rotatable communication with the hinge shaft, said first shaft engagement finger having a first shaft engagement upper surface configured to protrude beyond the hinge knuckle when said first guard element is attached to the hinge shaft, said first guard element including at least one first finger gap paired to and positioned adjacent said first shaft engagement finger; and mounting a first plate engagement end to the first hinge plate;

wherein a first transition body portion is positioned between said first shaft engagement finger and said first plate engagement end.

19. A method of protecting an automobile from damage from a garage door hinge as described in claim 18, further comprising:

attaching a second guard element to the hinge by:

press-fitting a second shaft engagement finger into rotatable communication with the hinge shaft, said second shaft engagement finger having a second shaft engagement upper surface configured to protrude beyond the hinge knuckle when said second guard element is attached to the hinge shaft, said second shaft engagement finger configured to rotate within said at least one first finger gap, said first shaft engagement finger configured to rotate within a second finger gap paired to and positioned adjacent said second engagement finger; and mounting a second plate engagement end to the second hinge plate;

wherein a second transition body portion is positioned between said second shaft engagement end and said second plate engagement end;

wherein said second guard element rotates independently from said first guard element.

20. A method of protecting an automobile from damage from a garage door hinge as described in claim 18, further comprising:

press-fitting said first plate engagement end into fixed attachment with said first hinge plate.

* * * * *

UNITED STATES PATENT AND TRADEMARK OFFICE

CERTIFICATE OF CORRECTION

PATENT NO. : 7,178,197 B2
APPLICATION NO. : 10/707887
DATED : February 20, 2007
INVENTOR(S) : Joseph Verheye, Sr.

It is certified that error appears in the above-identified patent and that said Letters Patent is hereby corrected as shown below:

In the Claims:

Claim 17:
Column 9, Line 21, should read as follows: --a first shaft engagement end rotatably engaging the hinge--

Signed and Sealed this

Twenty-fourth Day of July, 2007

JON W. DUDAS
*Director of the United States Patent and Trademark Office*